US006058546A

United States Patent [19]

Henderson

[11] Patent Number: 6,058,546

[45] Date of Patent: May 9, 2000

[54] MOTORIZED CHIMNEY SWEEP

[76] Inventor: Byron Henderson, 2975 Hwy. 38, Hartville, Mo. 65667

[21] Appl. No.: 09/037,372

[22] Filed: Mar. 10, 1998

[51] Int. Cl.[7] ..... F23J 3/00

[52] U.S. Cl. ..... 15/104.069; 15/104.14; 15/92

[58] Field of Search ..... 15/34, 249.1, 249.2, 15/249.3, 104.069, 104.068, 104.067, 104.066, 89, 91, 92, 104.14, 104.15, 104.13, 104.08, 104.09, 104.16, 104.17; 56/29

[56] References Cited

U.S. PATENT DOCUMENTS

| | | | |
|---|---|---|---|
| D. 119,977 | 4/1940 | Cramer et al. | 15/89 |
| 1,181,616 | 5/1916 | Sandblom | 15/104.14 |
| 2,236,064 | 3/1941 | McCarthy | 15/89 |
| 2,465,921 | 3/1949 | Peters | 15/104.14 |
| 3,742,545 | 7/1973 | Kravitz | 15/34 |
| 4,238,866 | 12/1980 | Taylor | 15/92 |
| 4,594,745 | 6/1986 | Pierce | 15/104.068 |
| 4,603,747 | 8/1986 | Golden | 15/104.069 |
| 4,835,409 | 5/1989 | Bhagwat et al. | 15/DIG. 1 |
| 5,089,037 | 2/1992 | Marsolais | 15/DIG. 1 |

FOREIGN PATENT DOCUMENTS

| | | | |
|---|---|---|---|
| 415763 | 7/1910 | France | 15/104.14 |
| 991092 | 10/1951 | France | 15/104.14 |
| 167700 | 2/1951 | Germany | 15/104.067 |
| 2028459 | 3/1980 | United Kingdom | 15/104.14 |
| 86/00391 | 1/1986 | WIPO | 15/104.14 |

*Primary Examiner*—Gary K. Graham
*Attorney, Agent, or Firm*—Shook, Hardy & Bacon LLP

[57] ABSTRACT

A motorized chimney sweep having a battery, a DC motor with twin drive shafts extending therefrom in opposite directions in a horizontal orientation, and two debris impacting members attached near a distal end of each drive shaft which are rotated through a generally vertical arc during use. In use, the debris impacting members rapidly strike debris which has built up within the shaft of a chimney to knock it free from the walls.

19 Claims, 6 Drawing Sheets

MOTORIZED CHIMNEY SWEEP

FIELD OF THE INVENTION

The present invention relates generally to cleaning devices and, more particularly, to a method and apparatus for removing debris which has built up on the inner walls of a chimney.

BACKGROUND OF THE INVENTION

Fireplaces and chimneys have been around since the dawn of civilization. So, too, has the problem of how to clean the chimney. After several fires have been burned in the fireplace, a shiny, black carbon-type substance begins to build up on the walls of the chimney. This build up is called "creosote." Apart from being a nuisance, this build up of creosote (hereinafter simply "debris") can become highly flammable. Over time, people have learned that regular cleanings of their chimneys reduces the risk of a chimney fire.

The most commonly used method of cleaning chimneys has not changed for centuries. The process initially involves a person getting up on the roof of a house to gain access to the chimney's opening. Next, the person inserts a large wire brush, generally of the same size and shape as the opening, down into the chimney. The brush is usually attached to a short pole so that it can be pushed further down into the chimney. The short pole usually has a male threaded portion on one end and a female threaded portion on the other end. This setup allows the user to screw several short poles together to create one long pole which is capable of pushing the brush to the bottom of the chimney. The user then moves the pole up and down inside the chimney causing the wire brush to knock the built up debris free from the walls.

While the old brush and pole method is capable of sufficiently cleaning a chimney when the user puts the requisite amount of time and energy into the cleaning process, the entire process is very labor intensive. The user must manually scrub the inside of the entire length of the chimney. In addition, the brush is often slightly larger than the space provided by the chimney's shaft. While this tight fit assists in cleaning the chimney to the bare walls, it greatly increases the amount of energy required to move the brush up and down during cleaning. Further, the user must not only raise and lower the weight of the brush along with its friction against the walls, but the user also has to contend with the added weight of each short pole section that has been attached to enable one to reach the bottom of the chimney.

Another drawback associated with using a wire brush to clean a chimney is that the brush does not clean the corners of a square or rectangular shaped chimney as well as it does the sides. The corners of a chimney are the places where the largest amounts of debris accumulate. Because the brush must be made in a square or rectangular shape, the brush wires that are to clean the corners are longer than the wires that are to clean the sides. The longer wires are not as stiff as the shorter wires and are therefore more likely to bend and leave debris on the walls. Additionally, because of the shape of the brush, the concentration of wires that are available to clean the sides of the chimney is greater than the concentration of wires available to clean the corners.

Yet another drawback of the brush and pole method of cleaning a chimney is that it requires a user to purchase several different pieces of equipment. Apart from all of the short poles needed, the user may be required to buy brushes of several different shapes and sizes, especially if the user wishes to clean several different chimneys. Therefore there is a need for a motorized chimney sweep which is compact, easy to use, and easily adaptable to fit chimneys of varying size and shape. The present invention overcomes the drawbacks of the prior art and fills these and other needs.

SUMMARY OF THE INVENTION

It is a general object of the present invention to provide a chimney sweep which can be used to quickly and efficiently clean debris from the inside of a chimney, including the corners of the chimney which can be difficult to clean using conventional chimney sweeps.

It is another object of the present invention to provide a chimney sweep that is motorized to greatly reduce the amount of manual labor required to clean a chimney.

A further object of the present invention is to provide a motorized chimney sweep that can be easily modified to clean chimneys of varying sizes and shapes.

In order to overcome the above stated problems and limitations and to achieve the noted objects, there is provided a motorized chimney sweep which has motor rotated debris impacting members for removing built-up debris from the inner walls of a chimney.

In general, the motorized chimney sweep comprises a motor for powering at least one rotatable drive shaft extending therefrom in a generally horizontal position during use and at least one debris impacting device which is attached to the drive shaft and rotated in a generally vertical arc during use.

More specifically, the preferred embodiment has an electric motor which is powered by a battery. The electric motor has two rotatable drive shafts which extend from the motor in opposite directions. Each of the drive shafts has a distal end located away from the electric motor. Attached to the distal end of each drive shaft is at least one debris impacting member. In the preferred embodiment, the distal end of each drive shaft has two debris impacting members which are located on opposite sides of each drive shaft. Further, in the preferred embodiment, the debris impacting members are chains having relatively small links. The small links easily remove the debris and do not damage the walls of the chimney like large links can.

In use, a user positions the motorized chimney sweep within the shaft of the chimney through the opening at the top of the chimney. The chimney sweep is attached to something which will facilitate the raising and lowering of the chimney sweep within the chimney, the simplest of which is an ordinary rope. The motor is then turned on, by use of a switch, thereby causing both drive shafts to begin to rotate around a generally horizontal axis. The debris impacting members which have been attached at the distal ends of the drive shafts begin to rotate around the drive shafts in a generally vertical arc. As the chimney sweep is lowered into the chimney, the debris impacting members begin to strike the interior corners of the chimney shaft, the location where the largest majority of debris buildup occurs. As the chimney sweep is continued to be lowered, the debris impacting members continue to knock the built up debris loose from the walls and corners of the chimney and the debris falls to the bottom of the chimney where it can be easily removed.

Further objects, features, and advantages of the present invention over the prior art will become apparent from the detailed description of the drawings which follows, when considered with the attached figures.

DESCRIPTION OF THE DRAWINGS

The objects and features of the invention noted above are explained in more detail with reference to the drawings, in which like reference numerals denote like elements, and in which.

DETAILED DESCRIPTION OF THE PREFERRED EMBODIMENT

Figure 1:
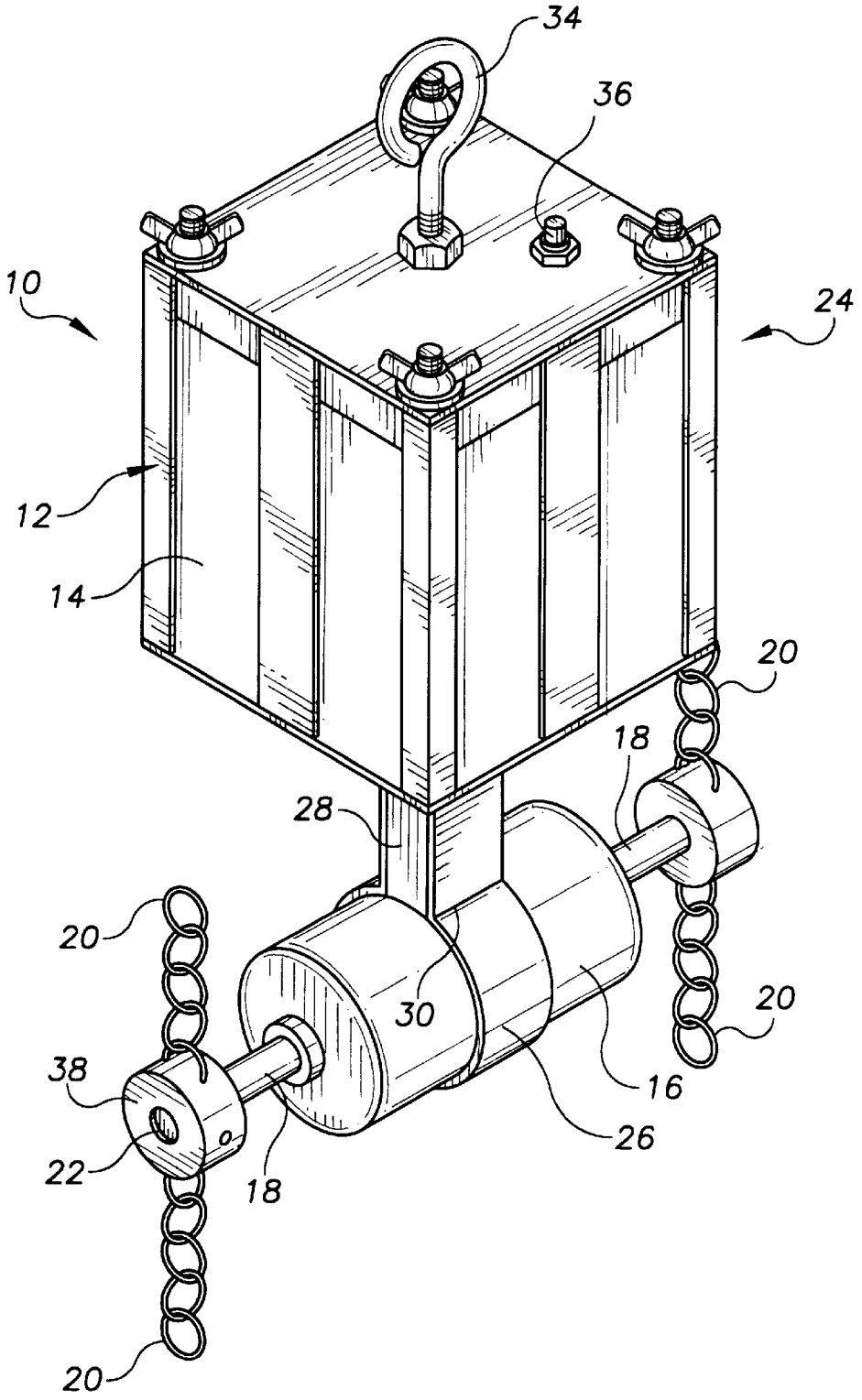
FIG. 1 is a perspective view of the preferred embodiment of the motorized chimney sweep of the present invention.
Figure 2:
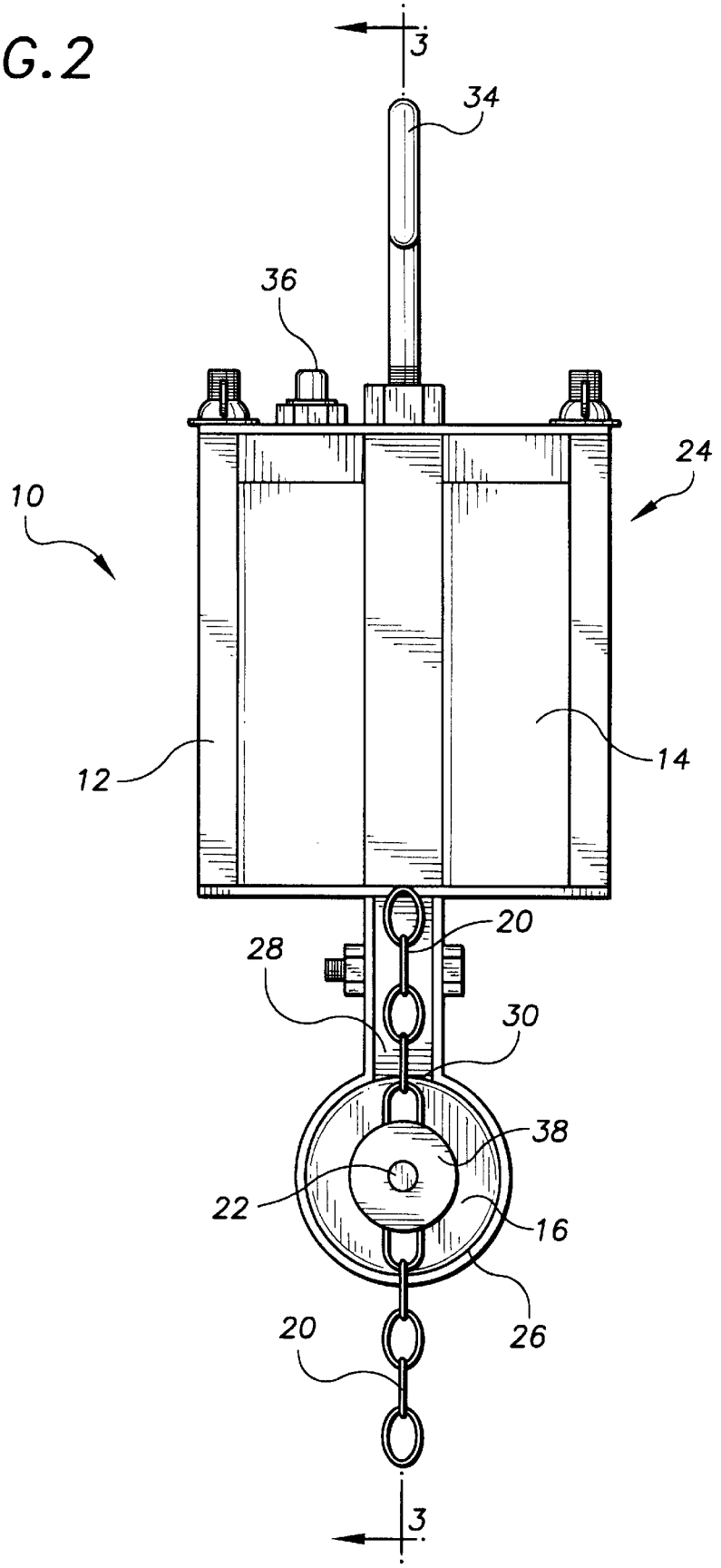
FIG. 2 is a side view of the preferred embodiment of the present invention.

Referring now to the drawings in detail and initially to FIG. 1, numeral 10 generally designates a motorized chimney sweep constructed in accordance with the preferred embodiment of the present invention. The chimney sweep 10 is primarily comprised of a frame 12, a battery 14, an electric motor 16, two generally horizontal drive shafts 18 which extend from the motor 16 in opposite directions, and four debris impacting members 20 which are attached to the drive shafts 18 near a distal ends 22 thereof.

Figure 3:
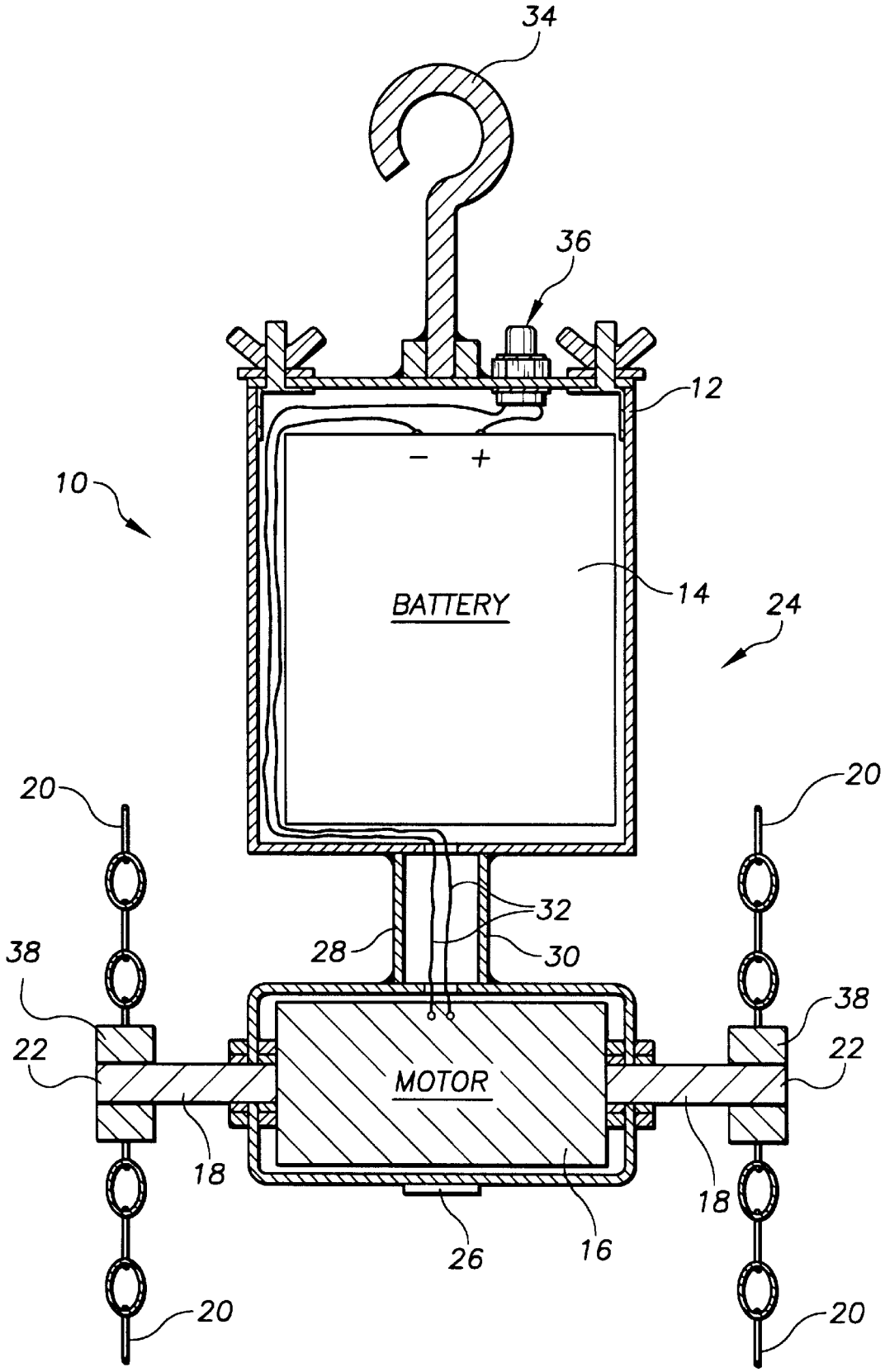
FIG. 3 is a front cross-sectional view taken along the lines 3—3 of FIG. 2 of the preferred embodiment of the present invention.

The frame 12 has three parts, a storage compartment 24, an electric motor retaining device 26, and a separation bar 28. The storage compartment 24 is devised to contain the battery 14 and protect it from any flying debris. Depending downwardly from the storage compartment 24 is the separation bar 28. The motor retaining device 26 is located at a distal end 30 of the separation bar 28. The separation bar 28 acts to separate the motor 16 from the storage compartment 24 in order to prohibit the debris impacting members 20 from contacting the storage compartment 24 housing the battery 14. The separation bar 28 should be of sufficient length to prohibit a rotating debris impacting member 20, which has been deflected out of its general vertical arc by impacting debris 84, from contacting any portion of the storage compartment 24 and thereby damaging the battery 14 contained therein. The separation bar is further provided to contain the necessary contacts which electrically connect the battery 14 to the motor 16 which, in the preferred embodiment, are electrical wires 32 (FIG. 3).

The motor retaining device 26 in the preferred embodiment is a metal ring which encircles the motor 16. The motor retaining device 26 securely retains the motor 16 to the distal end 30 of the separation bar 28. It should be noted that the particular method used to couple the motor 16 to the battery 14 is not important. The motor retaining device could be any known method of coupling the motor 16 to the battery 14 provided the motor is coupled securely such that electrical contact between the motor 16 and the battery 14 is not lost during use.

In the preferred embodiment, the frame 12 further includes an eye hook 34 on a top portion of the storage compartment 24. The eye hook 34 is preferably located in the center of the top portion of the storage compartment 24, equidistant from the edges of the top portion such that the chimney sweep 10 may be lowered in a primarily vertical orientation. The eye hook 34 permits a user to attach a rope 82, cable, chain, pole, or any other elongate member to the chimney sweep 10 to facilitate the raising and lowering the chimney sweep 10 within the chimney's inner chamber. The eye hook 34 need not necessarily be an eye hook but instead may be any type of attaching mechanism which facilitates attaching the chimney sweep to a device adapted to allow one to raise and lower the chimney sweep 10 within the chimney 80.

The battery 14 may be any type or size of battery known in the art which is capable of providing sufficient power to the electric motor 16 to rotate the drive shafts 18 at the necessary speed and with the necessary power required to cause the debris impacting members 20 to remove the debris 84 from the walls of a chimney 80. Preferably, the unit consists of a 12 volt deep cycle rechargeable gel battery.

The motor 16 in the preferred embodiment preferably has two drive shafts 18 which extend from the motor 16 in a horizontal orientation and in opposite directions of each other. Each drive shaft 18 terminates in a distal end 22. The motor 16 could be of any type sufficient to rotate a drive shaft having at least one debris impacting member attached thereon with sufficient force and speed to remove built up debris 84 from the inside of a chimney 80. In the preferred embodiment, the motor 16 is a 12 volt DC twin shaft motor and the speed is approximately 1,000 rpm.

In the preferred embodiment, and as best illustrated with reference to FIG. 3, the battery 14 is preferably connected to the electric motor 16 via two electrical wires 32. The electrical connection via the wires 32 further includes a switch 36 for turning the electric motor 16 on and off. The wiring scheme as used in the preferred embodiment and illustrated in FIG. 3 is a simple and commonly used arrangement. The wiring scheme could, of course, include other common electrical features such as a speed control, a thermal reset switch, and/or battery recharging wiring with an external connection. These electrical improvements would still be within the scope of the present invention and would provide the present invention with additional features. However, the preferred embodiment provides merely a simple on/off switch 36.

It should be noted also at this time that although the preferred embodiment powers the drive shafts 18 by using a battery 14 and an electric motor 16, it is well within the scope of the present invention to power the drive shafts 18 by other means. One could use a small internal combustion motor such as the type commonly used in a gasoline powered grass trimmer or an AC motor and provide power to the AC motor during use via a long electrical cable or extension cord. The preferred embodiment, however, uses the battery 14 and the electric motor 16.

The debris impacting members 20 in the preferred embodiment are small metal chains. While different materials could be used as debris impacting members 20 such as a cable, rope, plastic or metal fingers or multiple pieces of wire to form a wire brush, chains have been determined to be preferable due to their strength and natural tendency to react to surrounding conditions. For example, while rotating around the drive shaft 18, a chain would generally be in an extended, full length position. However, if the chain were to strike something solid, such as a wall of the chimney 80, the chain would be able to collapse such that the drive shaft 18 could continue to rotate. Additionally, chains can easily have their length adjusted by the adding or removing of links. This ability to easily adjust the length of the debris impacting numbers 20 permits one to use the same motorized chimney sweep 10 in a wide variety of chimneys.

Figure 4:
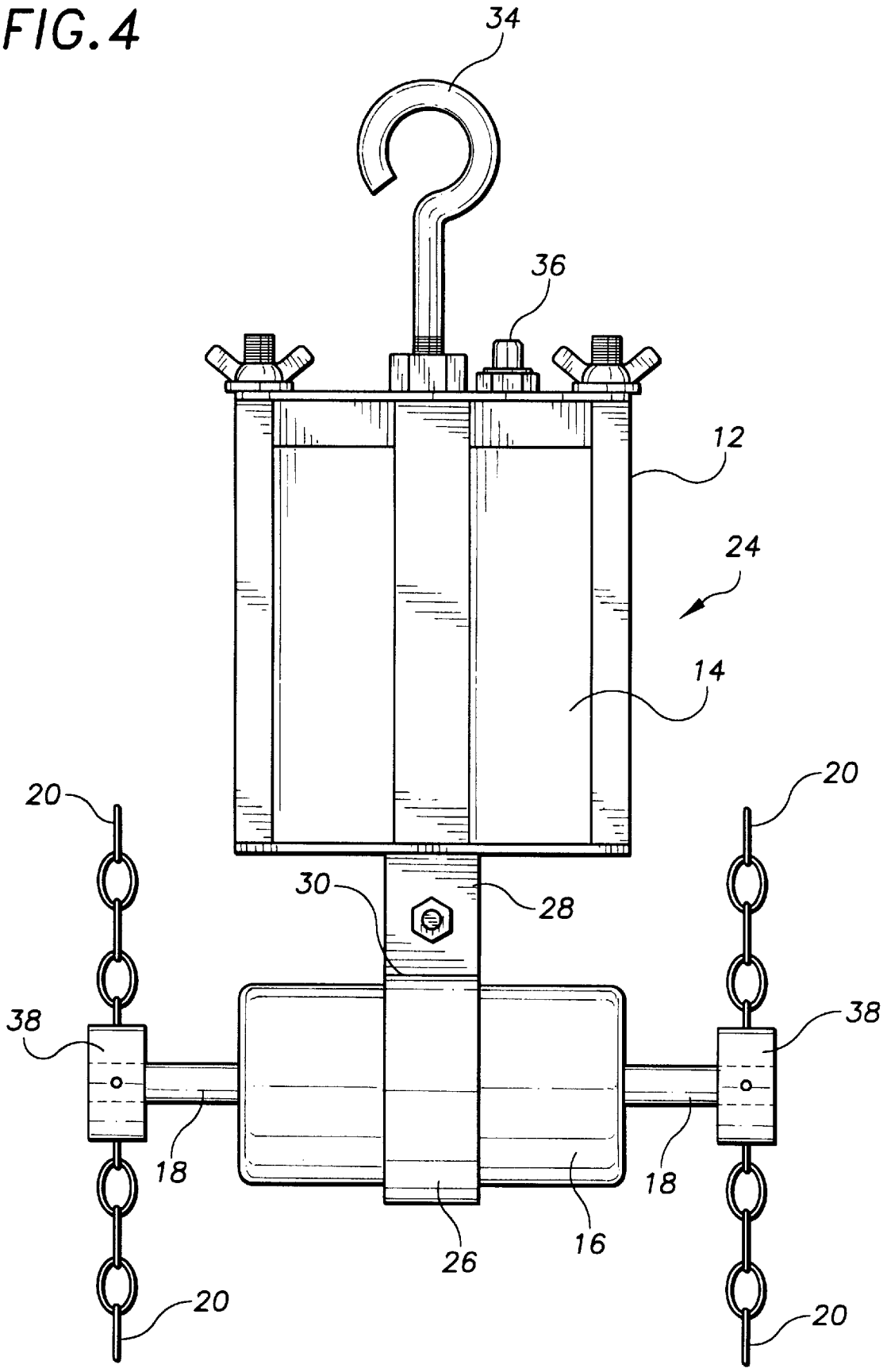
FIG. 4 is a front view of the preferred embodiment of the present invention.
Figure 6:
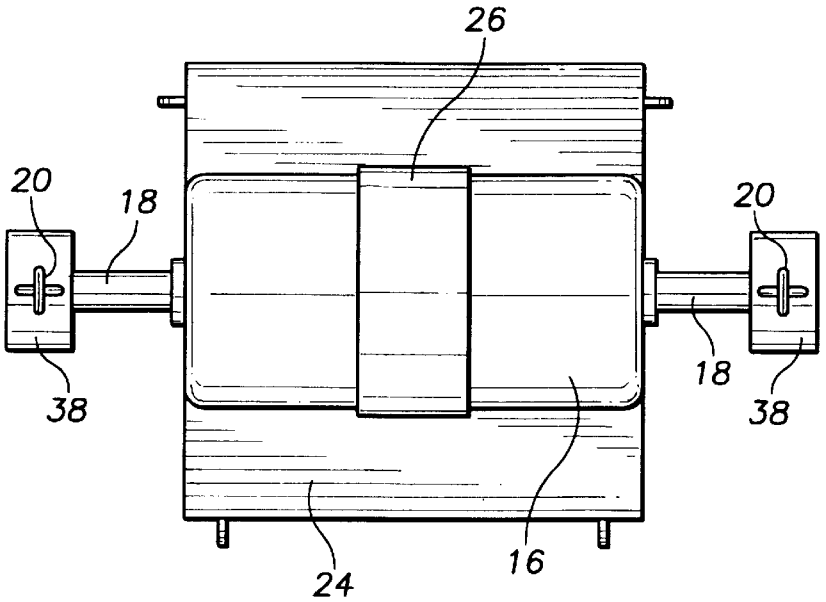
FIG. 6 is a bottom plan view of the preferred embodiment of the present invention.
Figure 5:
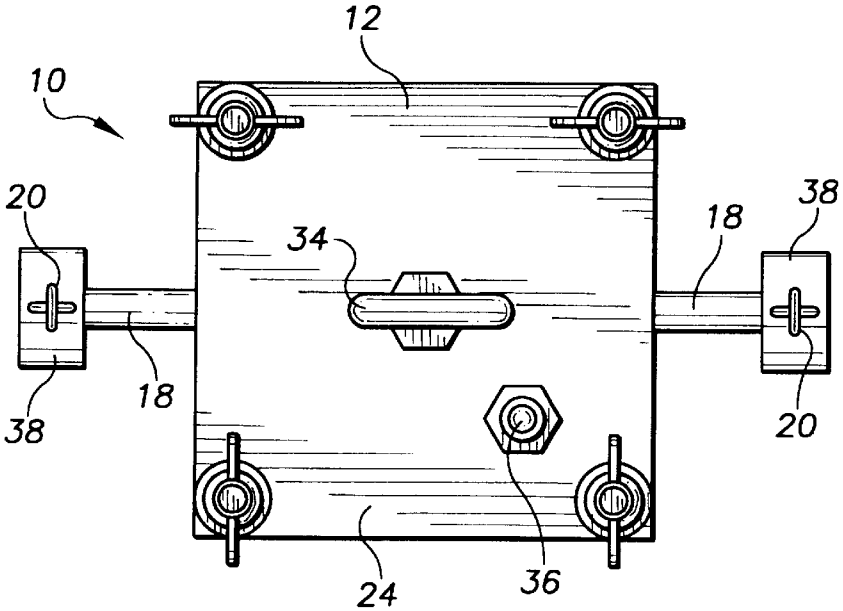
FIG. 5 is a top plan view of the preferred embodiment of the present invention.
Figure 7:
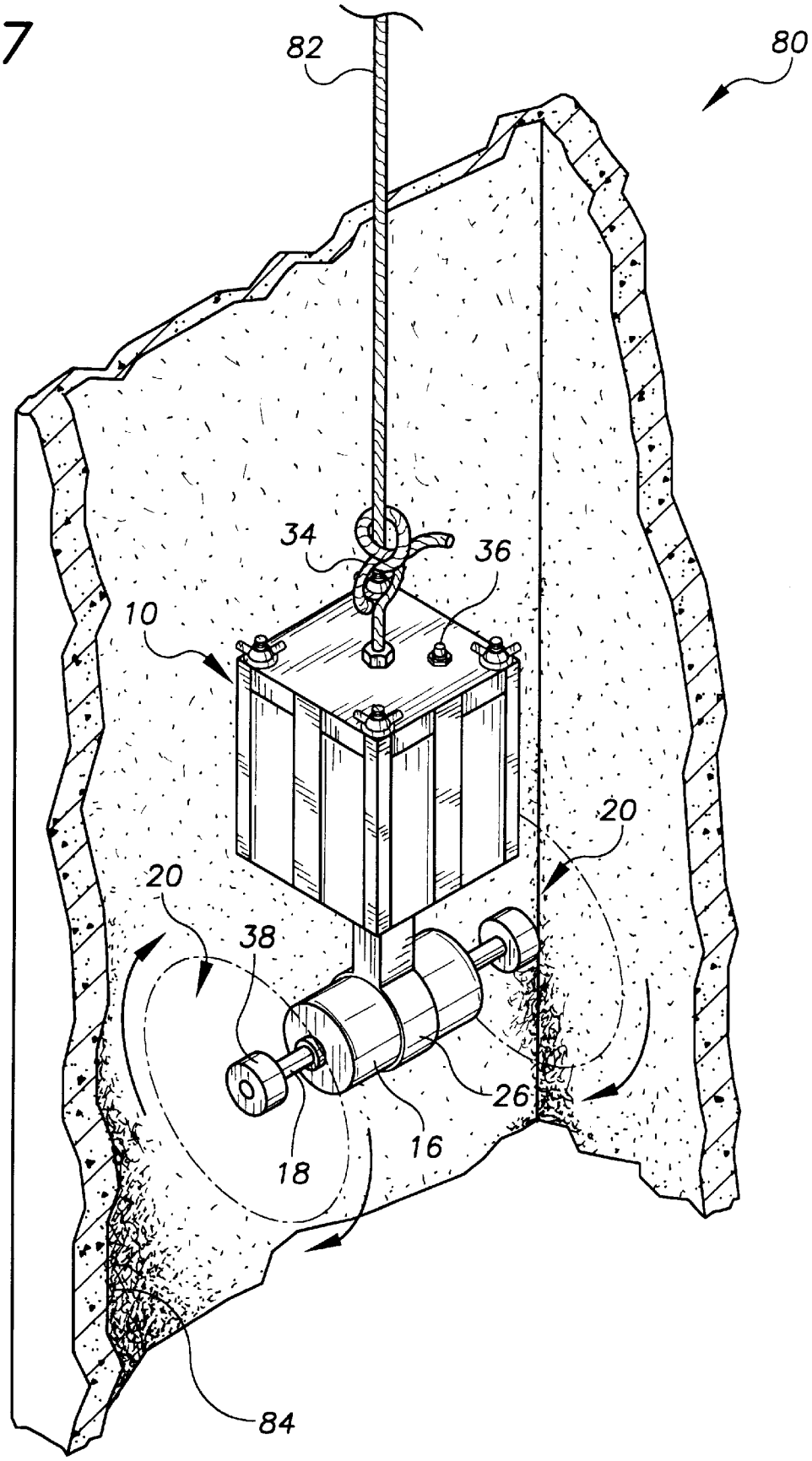
FIG. 7 is a perspective view of the preferred embodiment of the present invention in use within an inner shaft of a chimney.

In the preferred embodiment and as best illustrated in FIG. 4, the debris impacting members 20 are attached to the distal ends 22 of the drive shafts 18 by a hub 38. The debris impacting members 20 could, of course, be attached directly to the drive shafts 18. However, attachment to a hub allows quick removal of the debris impacting members 20 should one need to replace the electrical motor 16 or add a different set of debris impacting members 20. Further, the debris impacting members 20 could be attached to the drive shaft 18 at a point inward from the distal ends 22. However, it has been found preferable to attach the debris impacting members 20 to the drive shafts 18 at a point far enough away from the electric motor 16 and the storage compartment 24 of the frame 12 to minimize the amount of possible contact between the debris impacting members 20 and the electric motor 16 and battery 14.

The preferred embodiment has been designed to clean the standard chimney, one that uses 9"×9" standard flue tiles. Because of this, the width of the chimney sweep 10, as measured from the distal end 22 of one drive shaft 18 to the distal end 18 of the other drive shaft 22, is approximately 8 inches. Likewise, the depth of the chimney sweep 10, as measured from the tip of one debris impacting member 20 to the tip of the opposing debris impacting member 20, is approximately 8 inches. This arrangement gives a half inch clearance around the chimney sweep 10 while operating. This clearance minimizes the wear on the chimney walls while still removing approximately 90% of the built up debris 84 in one pass (down and back up). Should the user wish to remove the majority of the remaining 10% of the debris 84, one additional pass of the chimney sweep 10 after rotating it 90° with respect to the chimney 80 is all that is required.

The chimney sweep 10, is well adapted to clean the corners of the chimney 80. Because the debris impacting members 20 rotate through a generally vertical arc during use, the distal ends of the debris impacting members 20 can extend all the way into all four corners. If the drive shaft 18 was to rotate in a generally vertical orientation, thereby causing the debris impacting members 20 to rotate in a generally horizontal arc, the chimney sweep 10 could only clear a circular path down the chimney 80 and would be unable to clean debris 84 from the corners of the chimney 80.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

I claim:

1. A motorized chimney sweep for removing debris from inner walls of a chimney, said sweep comprising:

a frame having top and bottom ends and being adapted for being raised and lowered within said chimney when placed therein, said frame further having a storage compartment adapted to receive at least a portion of a battery, a motor retaining device and a separation bar;

a motor coupled with said frame via said motor retaining device and having a rotatable drive shaft; and at least one debris impacting member coupled with the drive shaft and rotatable therewith through a generally vertical arc to remove debris from the inner walls of said chimney when the sweep is placed therein and said motor is operated to cause rotation of the drive shaft.

2. The chimney sweep of claim 1, wherein said motor is an electric motor, said retaining device is adapted to securely fasten said electric motor to said frame and said separation bar is located between said storage compartment and said retaining device and is adapted to maintain a spaced relationship between said storage compartment and said electric motor.

3. The chimney sweep of claim 2, wherein said electric motor is powered by a battery.

4. The chimney sweep of claim 3, wherein said battery is located at said top end of said frame and said electric motor is located below said battery at said bottom end of said frame.

5. The chimney sweep of claim 2, wherein said electric motor has two drive shafts extending therefrom in opposite directions.

6. The chimney sweep of claim 5, wherein each of said two drive shafts has two debris impacting devices attached thereto on opposite sides of said drive shafts.

7. The chimney sweep of claim 1, further comprising a means for facilitating the raising and lowering of said chimney sweep within a chimney.

8. The chimney sweep of claim 7, wherein said means for facilitating the raising and lowering of said chimney sweep within a chimney comprises an eye hook attached to said frame.

9. The chimney sweep of claim 1, wherein said debris impacting member is a chain.

10. A motorized electric chimney sweep, comprising:

a battery;

a frame having a storage compartment, a motor retaining device and a separation bar;

a DC motor having at least two drive shafts extending horizontally therefrom in opposing directions, said motor being attached to said battery by a plurality of wires; and at least one debris impacting member connected to a distal end of each of said drive shafts, each of said members having a free, debris impacting end and an attachment end, said debris impacting members being attached to said drive shafts at said attachment ends.

11. The chimney sweep of claim 10, wherein said storage compartment is adapted to receive said battery, said motor retaining device is adapted to securely retain said motor and said separation bar extends outwardly from a surface of said storage compartment to a distal end where said motor retaining device is attached, said extension bar being adapted to receive said wires connecting said battery to said motor.

12. The chimney sweep of claim 11, wherein said frame further comprises means for attaching said chimney sweep to a device adapted to raise and lower said chimney sweep within a chimney.

13. The chimney sweep of claim 12, wherein said means for attaching said chimney sweep to a device adapted to raise and lower said chimney sweep within a chimney comprises an eye hook.

14. The chimney sweep of claim 10, wherein said debris impacting members are a chain.

15. The chimney sweep of claim 10, wherein each of said distal ends of said drive shafts have two debris impacting members attached on opposite sides of said drive shafts.

16. The chimney sweep of claim 10, further comprising means for facilitating the raising and lowering of said chimney sweep within a chimney.

17. A motorized chimney sweep for removing debris from inner walls of a chimney, said sweep comprising:

a motor having a rotatable drive shaft;

a frame coupled with said motor and having top and bottom ends and being adapted for being raised and lowered within said chimney when placed therein, said frame further having a storage compartment adapted to receive at least a portion of a battery, a motor retaining device, said retaining device adapted to securely fasten said motor to said frame, and a separation bar, said separation bar being located between said storage compartment and said retaining device and being adapted to maintain a spaced relationship between said storage compartment and said electric motor; and at least one debris impacting member coupled with the drive shaft and rotatable therewith through a generally vertical arc to remove debris from the inner walls of said chimney when the sweep is placed therein and said motor is operated to cause rotation of the drive shaft.

18. The chimney sweep of claim 17, further comprising a battery and wherein said motor is electric, is powered by said battery and has two drive shafts extending therefrom in opposite directions.

19. The chimney sweep of claim 18, wherein each of said two drive shafts has two debris impacting devices attached thereto on opposite sides of said drive shafts.

* * * * *